US008657164B2

(12) United States Patent
Reeves et al.

(10) Patent No.: US 8,657,164 B2
(45) Date of Patent: Feb. 25, 2014

(54) MOLTEN METAL LEAKAGE CONFINEMENT AND THERMAL OPTIMIZATION IN VESSELS USED FOR CONTAINING MOLTEN METAL

(75) Inventors: Eric W. Reeves, Hayden Lake, ID (US); James Boorman, Greenacres, WA (US); Robert Bruce Wagstaff, Greenacres, WA (US); Randal Guy Womack, Spokane Valley, WA (US)

(73) Assignee: Novelis Inc., Atlanta, GA (US)

( * ) Notice: Subject to any disclaimer, the term of this patent is extended or adjusted under 35 U.S.C. 154(b) by 258 days.

(21) Appl. No.: 13/066,474

(22) Filed: Apr. 14, 2011

(65) Prior Publication Data

US 2011/0253581 A1 Oct. 20, 2011

Related U.S. Application Data

(60) Provisional application No. 61/342,841, filed on Apr. 19, 2010.

(51) Int. Cl.
*B22D 41/56* (2006.01)
*B22D 41/00* (2006.01)

(52) U.S. Cl.
USPC ..... 222/591; 266/196

(58) Field of Classification Search
USPC ..... 206/524.1, 524.2, 524.3; 266/275, 280, 266/227, 236, 196; 264/30, 261, 511, 516; 222/591, 607, 594; 164/437, 335, 337, 164/338.1
See application file for complete search history.

(56) References Cited

U.S. PATENT DOCUMENTS 4,055,336 A * 10/1977 Massin ..... 266/283
(Continued)

FOREIGN PATENT DOCUMENTS

| | | | | |
|---|---|---|---|---|
| GB | 2104633 | * | 6/1981 | ..... B22D 41/02 |
| GB | 2 104 633 | | 3/1983 | |
| WO | WO 95/21273 A1 | | 8/1995 | |

OTHER PUBLICATIONS

U.S. Appl. No. 12/928,354, filed Dec. 8, 2010, Reeves et al.
(Continued)

*Primary Examiner* — Scott Kastler
*Assistant Examiner* — Michael Aboagye
(74) *Attorney, Agent, or Firm* — Kilpatrick Townsend & Stockton LLP

(57) ABSTRACT

A vessel used for containing molten metal, e.g. a trough section for conveying molten metal from one location to another. The vessel has a refractory liner made of at least two refractory liner units positioned end to end, with a joint between the units, the units each having an exterior surface and a metal-contacting interior surface. A housing at least partially surrounds the exterior surfaces of the refractory liner units with a gap present between the exterior surfaces and the housing. Molten metal confinement elements, impenetrable by molten metal, are positioned on opposite sides of the joint within the gap, at least below a horizontal level corresponding to a predetermined maximum working height of molten metal held within the vessel in use, to partition the gap into a molten metal confinement region between the elements and at least one other region that may be used to hold equipment such as electrical heaters that may be damaged by contact with molten metal. Another embodiment employs refractory liner units of different thermal conductivity to maximize heat penetration into the molten metal from heaters in the gap, but to minimize heat loss at the inlet and outlet of the vessel where the end units contact the housing.

11 Claims, 5 Drawing Sheets

(56) References Cited

U.S. PATENT DOCUMENTS

| | | | | |
|---|---|---|---|---|
| 4,194,730 | A | 3/1980 | Matsumoto et al. | |
| 4,531,717 | A * | 7/1985 | Hebrant | 266/166 |
| 4,573,668 | A * | 3/1986 | LaBate | 266/196 |
| 5,316,071 | A | 5/1994 | Skinner et al. | |
| 6,973,955 | B2 * | 12/2005 | Tingey et al. | 164/133 |
| 2008/0163999 | A1 | 7/2008 | Hymas et al. | |

OTHER PUBLICATIONS

U.S. Appl. No. 12/928,355, filed Dec. 8, 2010, Reeves et al.
U.S. Appl. No. 12/928,356, filed Dec. 8, 2010, Reeves et al.
U.S. Appl. No. 12/928,353, filed Dec. 8, 2010, Boorman et al.
U.S. Appl. No. 13/066,486, filed Apr. 14, 2011, Hymas et al.
Canadian Intellectual Property Office, International Search Report, Jun. 21, 2011, PCT/CA2011/000393 (Novelis Inc., et al.).

* cited by examiner

MOLTEN METAL LEAKAGE CONFINEMENT AND THERMAL OPTIMIZATION IN VESSELS USED FOR CONTAINING MOLTEN METAL

CROSS-REFERENCE TO RELATED APPLICATION

This application claims the priority right of prior U.S. provisional patent application Ser. No. 61/342,841 filed Apr. 19, 2010 by applicants named herein. The entire disclosure of application Ser. No. 61/342,841 is incorporated herein by this reference for all purposes.

BACKGROUND OF THE INVENTION

I. Field of the Invention

This invention relates to vessels used for containing and/or conveying molten metals and, especially, to such vessels having two or more refractory lining units that come into direct contact with each other and with the molten metals during use. More particularly, the invention addresses issues of molten metal leakage and thermal optimization in such vessels.

II. Background Art

A variety of vessels for containing and/or conveying molten metals are known. For example, molten metals such as molten aluminum, copper, steel, etc., are frequently conveyed through elongated troughs (sometimes called launders, runners, etc.) from one location to another, e.g. from a metal melting furnace to a casting mold or casting apparatus. In recent times, it has become usual to make such troughs out of modular trough sections that can be used alone or joined together to provide an integral trough of any desirable length. Each trough section usually includes a refractory liner that in use comes into contact with and conveys the molten metal from one end of the trough to the other. The liner may be surrounded by a heat insulating material, and the combined structure may be held within an external housing or shell made of metal or other rigid material. The ends of each trough section may be provided with an enlarged cross-plate or flange that provides structural support and facilitates the connection of one trough section to another (e.g. by bolting abutting flanges together).

It is also known to provide metal conveying troughs with heating means to maintain the temperature of molten metal as it is conveyed through the trough, and such heating means may be positioned within the housing close to an external surface of the refractory liner so that heat is transferred through the liner wall to the metal within. For example, U.S. Pat. No. 6,973,955 which issued on Dec. 13, 2005 to Tingey et al. discloses a trough section having an electrical heating element beneath the refractory liner held within an external metal housing. In this case, the refractory liner is made of a material of relatively high heat conductivity, e.g. silicon carbide or graphite. A disadvantage noted for this arrangement is that molten metal may leak from the liner (e.g. through cracks that may develop during use) and cause damage to the heating element. To protect against this, a metal intrusion barrier is provided between the bottom of the refractory liner and the heating element. The barrier may take the form of a screen or mesh made of a non-wettable (to molten metal) heat-resistant metal alloy, e.g. an alloy of Fe—Ni—Cr. While the molten metal intrusion barrier of the above patent can be effective, it is usually difficult to install in such a way that all of the molten metal resulting from a leak is prevented from contacting the heating element. Also, this solution to the problem of metal leakage tends to be expensive, particularly when exotic alloys are employed for the barrier.

The problem of molten metal leakage from the refractory liner is increased when the liner itself is made up of two or more liner units abutted together within a trough or trough section. The joint between the two liner units forms a weak spot where metal may penetrate the liner. The use of two or more such units is necessary in many cases because there is a practical limit to the lengths in which the refractory liner units can be made without increasing the risk of cracking or mechanical failure, but trough sections longer than this limit may be necessary to minimize the number of sections required for a complete trough run. When a trough section contains two or more refractory liner units joined end to end, the units are generally held together with compressive force (provided by the housing and end flanges) and the intervening joint is commonly sealed only with a compressible layer of refractory paper or refractory rope. Over time, such seals degrade and an amount of molten metal commonly leaks through the liner into the interior of the housing. If the trough section contains one or more heating elements or other devices, the molten metal will often find its way to such heating elements or devices and cause equipment damage and electrical shorts.

A further disadvantage of known equipment is that, when heated troughs or trough sections are utilized, a refractory lining of high heat conductivity is generally utilized to allow efficient heat transfer through the refractory material of the trough liner. However, this can have the disadvantage that heat is conducted along the refractory liner to the metal end flange, thereby creating a region of high heat loss from the liner and a hazardous region of high temperature on the exterior of the housing.

Accordingly, there is a need for improvement of trough sections of this general kind in order to address some or all of these problems and possibly additional issues.

SUMMARY OF THE INVENTION

An exemplary embodiment provides a vessel used for containing molten metal. The vessel includes a refractory liner having at least two refractory liner units positioned end to end, with a joint between the units, the units each having an exterior surface and a metal-contacting interior surface. The vessel also has a housing at least partially surrounding the exterior surfaces of the refractory liner units with a gap present between the exterior surfaces and the housing. Molten metal confinement elements, impenetrable by molten metal, are positioned on opposite sides of the joint within the gap, at least below a horizontal level corresponding to a predetermined maximum working height of molten metal held within the vessel in use, to partition the gap into a molten metal confinement region between the elements and at least one other region. The confinement elements prevent molten metal in the confinement region from penetrating into the other region(s) of the gap within the housing so that these regions may be used to house equipment (e.g. heating devices such as electrical heaters) that would be damaged by contact with molten metal. Thus, rather than providing a barrier to restrain molten metal that may penetrate through any part of the refractory liner of the vessel, a confinement area or escape route is provided for any such penetrating molten metal based on the observation that the most likely place for such metal penetration is at junctions between units that make up the refractory liner. In this way, the molten metal is kept away from areas of the vessel interior that where damage may be caused.

Another exemplary embodiment relates to a vessel used for containing molten metal having an inlet for molten metal and an outlet for molten metal. The vessel includes a refractory liner made up of abutting refractory liner units. The units include at least one intermediate refractory liner unit and two end units with one of the end units being positioned at the molten metal inlet and the other of the end units positioned at the molten metal outlet. The intermediate unit(s) is (are) positioned between the end units remote from the inlet and the outlet. The refractory liner units each have an exterior surface and a metal-contacting interior surface. A housing contacts the end units and at least partially surrounds the exterior surfaces of the refractory liner units with a gap present between the exterior surfaces of the intermediate unit(s) and the housing. A heating device is positioned in the gap adjacent to the intermediate unit(s). The liner units are made of refractory materials and the material the end units (or at least one of them) has a lower heat conductivity than the refractory material of the intermediate unit(s). This maximizes heat penetration from the heating device through the refractory material of the intermediate unit(s), but minimizes heat loss through the end unit(s) to the housing adjacent to the molten metal inlet and outlet.

The both exemplary embodiments, the vessel may take a variety of forms, but is preferably a trough or trough section used for conveying molten metal, in which case the refractory liner is elongated and has an inlet for molten metal inflow at one end and an outlet for molten metal outflow at an opposite end. The metal contacting interior surfaces of the liner units may form an open-topped molten metal conveying channel or, alternatively, a closed channel (e.g. with the refractory liner forming a pipe).

A preferred exemplary embodiment relates to a trough section for conveying molten metal, the trough section comprising: at least two refractory lining units positioned end to end, with a joint between the units, to form an elongated refractory lining, the units each having an exterior surface and a longitudinal metal-conveying channel open at an upper side of the exterior surface, a housing at least partially surrounding the refractory lining units, except at the upper sides, with a gap formed between the refractory lining units and the housing; and a pair of metal-confinement elements, impervious to molten metal, positioned one on each side of the joint and surrounding the exterior surfaces of the refractory lining units, at least below a horizontal level corresponding to a predetermined maximum working height of molten metal conveyed by the trough section in use, and bridging the gap between the exterior surface and an internal surface of the housing; wherein each of the confinement elements has surfaces conforming in shape to the external surface and to the internal surface to thereby form a molten-metal confinement region between the confinement elements for containing and confining any molten metal that in use leaks from the joint.

Another preferred exemplary embodiment provides a trough section for conveying molten metal, the trough section comprising: at least two refractory lining units positioned end to end to form an elongated refractory lining having opposed longitudinal ends, the units each having a longitudinal metal-conveying channel open at an upper side, and a housing at least partially surrounding the refractory lining units, except at the upper sides, and including a transverse end wall contacting and partially surrounding one of the longitudinal ends of the refractory lining, wherein the refractory lining unit contacting the transverse end wall is made of a refractory material of lower heat conductivity than a material of at least one other refractory lining unit forming the elongated refractory lining.

It is preferable to provide trough sections according to the exemplary embodiments with at least two intermediate units per trough section because refractory lining units have a greater tendency to crack as their length increases, so there is a practical maximum length in which they can be made (which may vary according to the material chosen but is often in the range of 400 to 1100 mm). Furthermore, when the refractory lining of a trough section is heated from within the trough section, it is desirable to make the section as long as possible to maximize the length of trough that is heated. The end regions of trough sections where the sections are joined cannot be heated and, indeed, heat loss to the section end walls may occur there, so it is desirable to minimize the number of trough sections used to produce a required length of trough. This maximizes the heat input per unit trough length. While it is not preferred, a short trough module constructed with a single intermediate refractory lining unit may be necessary due to the constraints of distance between other equipment in the molten metal stream. Trough sections can generally be made in any suitable length by adjusting the number of refractory lining units per trough. Lengths from 570 mm up to 2 m, more preferably 1300 to 1800 mm, are usual. The actual length chosen from this range is determined by ease of installation, minimizing unheated sections required to interface with other equipment in the molten metal stream, and ease of handling and transportation.

The trough sections of the exemplary embodiments may be used to convey molten metals of any kind provide the refractory lining units (and metal confinement elements) are made of materials that can withstand the temperatures encountered without deformation, melting, disintegration or chemical reaction. Ideally, the refractory materials withstand temperatures up to 1200° C., which would make them suitable for aluminum and copper, but not steel (refractories capable of withstanding higher temperatures would be required for steel and are available). Most preferably, the trough sections are intended for use with aluminum and its alloys, in which case the refractory materials would have to withstand working temperatures in the range of only 400 to 800° C.

The term "refractory material" as used herein to refer to metal containment vessels is intended to include all materials that are relatively resistant to attack by molten metals and that are capable of retaining their strength at the high temperatures contemplated for the vessels. Such materials include, but are not limited to, ceramic materials (inorganic non-metallic solids and heat-resistant glasses) and non-metals. A non-limiting list of suitable materials includes the following: the oxides of aluminum (alumina), silicon (silica, particularly fused silica), magnesium (magnesia), calcium (lime), zirconium (zirconia), boron (boron oxide); metal carbides, borides, nitrides, silicides, such as silicon carbide, particularly nitride-bonded silicon carbide (SiC/Si3N4), boron carbide, boron nitride; aluminosilicates, e.g. calcium aluminum silicate; composite materials (e.g. composites of oxides and non-oxides); glasses, including machinable glasses; mineral wools of fibers or mixtures thereof; carbon or graphite; and the like.

DETAILED DESCRIPTION OF THE EXEMPLARY EMBODIMENTS

Figure 1:
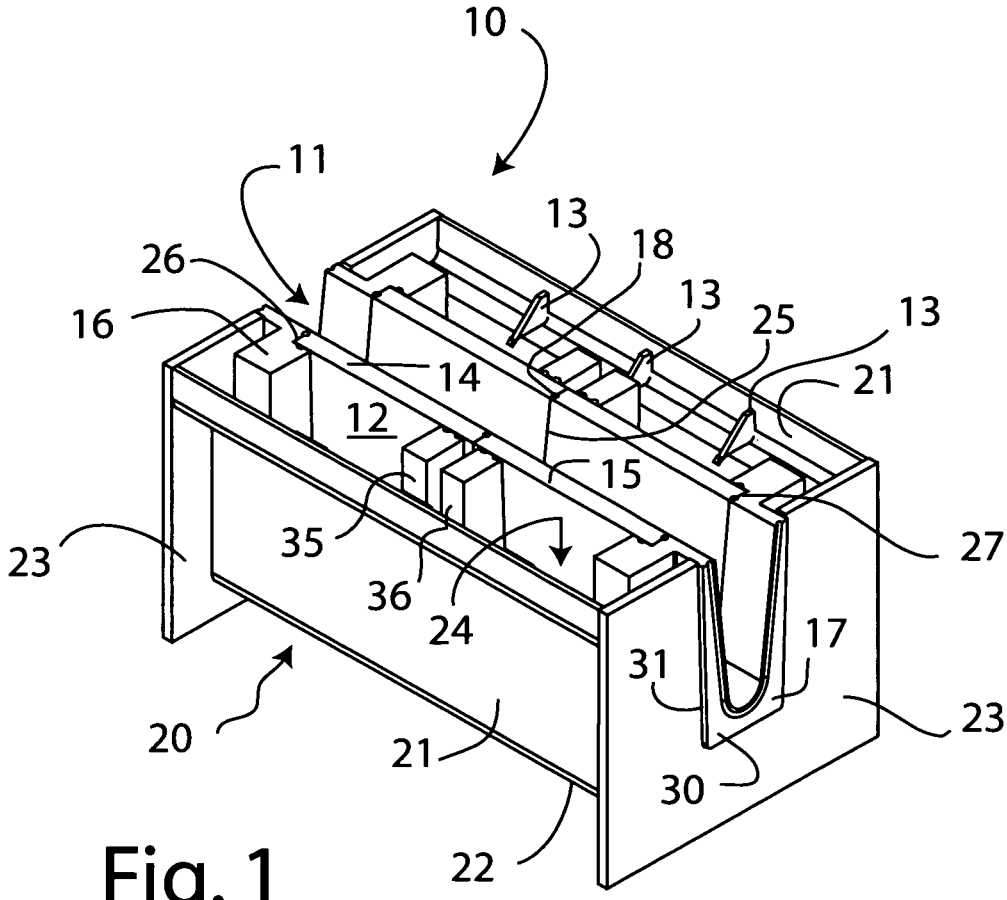
FIG. 1 is a perspective view of a trough section, with top plates removed for clarity, according to one exemplary embodiment of the invention.
Figure 2:
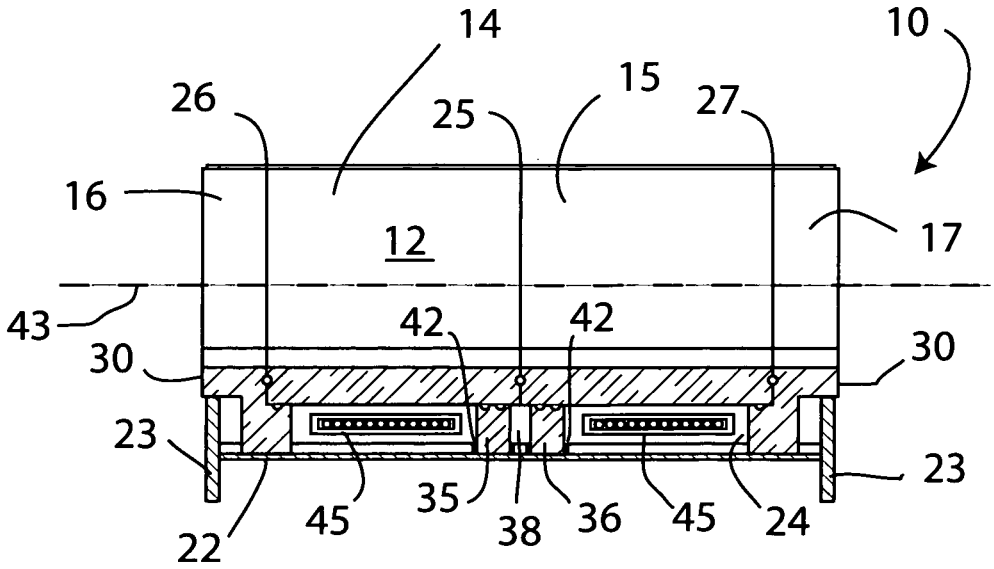
FIG. 2 is a vertical longitudinal cross-section of the trough section of FIG. 1.
Figure 3:
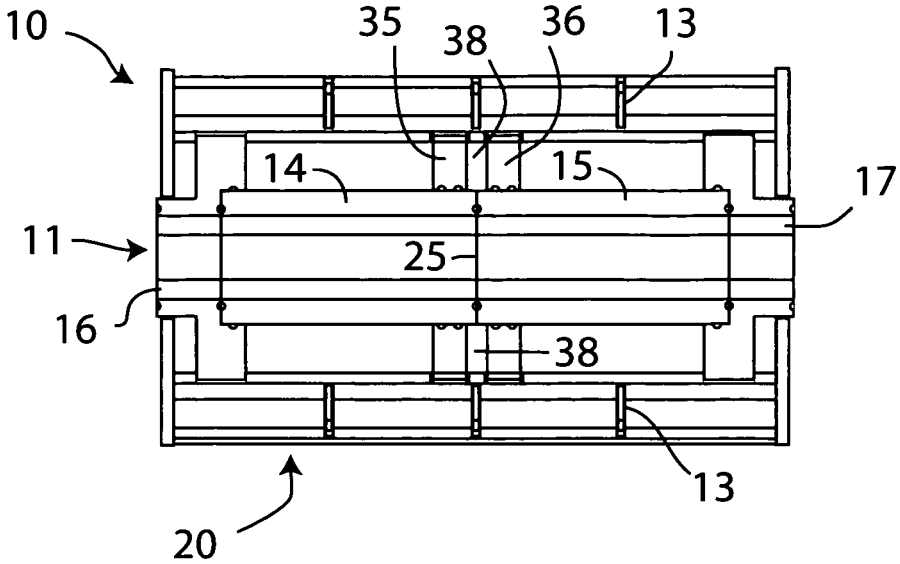
FIG. 3 is a top plan view of the trough section of FIGS. 1 and 2.

A first exemplary embodiment of the invention, illustrating a metal containment vessel in the form of a trough section of a kind used for conveying molten metal from one location to another, is shown in FIGS. 1 to 3. The trough section 10 may be used alone for spanning short distances, or it may be joined with one or more similar or identical trough sections to form a longer modular metal-conveying trough. It should be noted that the trough section shown in these drawings is normally provided with two horizontal longitudinal metal top plates, one running along each side of metal-conveying channel 11, forming a top part of an external housing 20, but such top plates have been omitted from the drawing to reveal interior elements. Heat insulation, e.g. in the form of refractory insulating boards or fibrous batts, normally provided within the housing, has also been omitted for clarity. Reinforcing elements 13 (provided to strengthen the housing 20) are also shown in FIG. 1 on one side only of the channel 11, but are present on both sides as can be seen from FIG. 3.

The metal-conveying channel 11 is formed by four refractory liner units that together make up an elongated refractory liner 12 that contains and conveys the molten metal from one end of the trough section to the other during use. The four refractory liner units comprise two intermediate units 14 and 15, and two end units 16 and 17. These open-topped generally U-shaped units are aligned longitudinally to form the liner 12 and are held in place within the housing 20. The housing is usually made of a metal such as steel and (in addition to the top plates mentioned above) has sidewalls 21, a bottom wall 22 and a pair of enlarged transverse end walls 23 that form flanges that support the section and facilitate attachment of one such trough section to another (e.g. by bolting flanges of adjacent sections together). The housing 20 surrounds the refractory liner units except at the open upper sides thereof but with a gap 24 present between the refractory lining units and adjacent inside surfaces of the sidewalls 21 and bottom wall 22. The sidewalls, bottom wall and end walls may be joined together so that any molten metal that leaks into the housing from the channel 11 does not leak out, or alternatively, they may have gaps (e.g. between the bottom wall and the sidewalls), that allows molten metal leakage.

Figure 8:
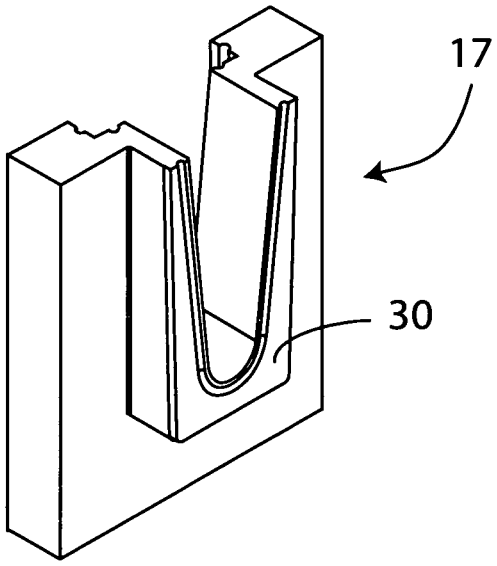
FIG. 8 is a perspective view of a refractory liner end unit as used in the embodiment of FIGS. 1 to 3 and 5 to 7, but shown in isolation and on an enlarged scale.

The two intermediate refractory liner units 14 and 15 butt together to form a joint 25 that is sealed against molten metal leakage, e.g. by providing a layer of a compressible refractory is paper between the units or a refractory rope compressed within a groove 18 provided in the abutting faces or cut into the channel faces of the units to overlap the joint. Similar joints 26 and 27 are formed between the end units 16, 17 and their abutting intermediate units 14 and 15, although the end units have parts that extend for a short distance along the outside of the intermediate units as shown (see FIG. 2) and thus present a more complex or convoluted path against escape of molten metal from the channel 11 through the joints 26, 27. These joints are also provided with a seal of refractory paper or rope or the like to prevent the escape of molten metal. The parts of end units 16 and 17 that extend along the outside of units 14 and 15 also enable the end units 16 and 17 to provide support for the intermediate units 14 and 15, since the end units in turn rest on the bottom wall 22 of the housing, as can be seen from FIG. 2. However, such physical support is not essential and may not even be preferred if it results in the development of undesirable mechanical loads on the refractory end units that may result in cracking or failure of the refractory end units. The end units 16 and 17 also each have a projecting part 30 that extends through a rectangular cut-out 31 in end walls 23 and the projecting part ends slightly proud of the adjacent end wall (normally by an amount in a range of 0-10 mm, and preferably about 6 mm) so that trough sections 10 may be mounted end-to-end with the projecting parts 30 in abutting and aligned contact with each other to prevent molten metal loss at the interface. The cut-out 31 fits closely around the projecting part 30 so that support for the end units 16 and 17 is also provided by the end walls 23 of the housing 20. An end unit 17 is shown for clarity in isolation in FIG. 8.

Figure 4:
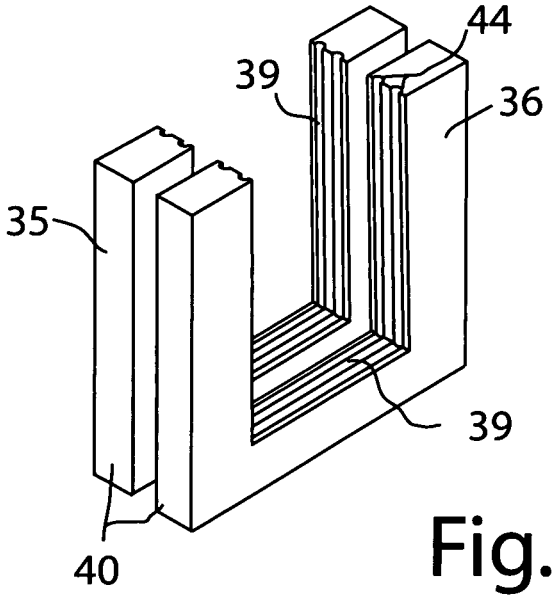
FIG. 4 is a perspective view of metal confinement elements as used in the embodiment of FIGS. 1 to 3, but shown in isolation and on an enlarged scale.

As noted above, the two intermediate refractory liner units 14 and 15 abut each other at joint 25. A pair of metal confinement elements 35 and 36 is provided in gap 24, with one such element being located on each opposite side of the joint 25 to define a metal confinement region 38 therebetween. This region is referred to as a metal-confinement region because, if molten metal leaks from the channel 11 through the joint 25 during use of the trough section—as may occur if the seal between units 14 and 15 begins to fail—the molten metal leaks into the confinement region 38 and is constrained against movement to other parts of the interior of the housing 20. If the housing 20 has no outlets in the confinement region, any molten metal that leaks into the confinement region is held there permanently and may solidify on contact with the interior surfaces of the housing. On the other hand, if the housing 20 has outlets (e.g. if there is a gap between the bottom wall and the sidewalls of the housing), molten metal may leak out to the exterior of the housing (if it remains molten) where it may optionally be collected in a suitable container or channel. As mentioned, an important feature is that the confinement elements 35 and 36 prevent movement of molten metal beyond the confinement region to other interior parts of the housing. To ensure such confinement of the molten metal, the elements 35 and 36, which are shown in isolation in FIG. 4, have inner surfaces 39 and outer surfaces 40 that conform closely in shape to the external surfaces of the refractory liner units 14 and 15 and to the inner surface of the housing 20, respectively, thereby forming a barrier or dam against metal exfiltration from the region 38 along the interior surface of the housing. The confinement elements may also be considered to form a saddle or cradle beneath the refractory lining 12 into which the refractory lining is seated, and may provide physical support for the refractory liner units 14 and 15, e.g. if the confinement elements are made from an incompressible substance. However, such physical support is not essential and may not even be preferred if it results in the development of undesirable mechanical loads on the confinement elements that may result in cracking or failure of the confinement elements or the refractory liner end units. The metal confinement elements are preferably imperforate to penetration by molten metal (i.e. they are solid or have pores or holes too small to allow molten metal to flow through) and are resistant to high temperatures and to attack by molten metal. They should also preferably be of relatively low heat conductivity (e.g. preferably below about 1.4 W/m−° K, e.g. in a range of about 0.2-1.1 W/m−° K) to prevent undue heat loss from the molten metal in the channel 11 to the housing 20. Suitable materials for the confinement elements include fused silica, alumina, alumina-silica blends, calcium silicate, etc. To provide a good seal against molten metal penetration, the inner surfaces 39 are preferably provided with parallel grooves 44 for receiving a compressible sealing element such as a refractory rope or a bead of moldable refractory material (not shown). The outer surfaces may be grooved and sealed in the same way but, because they contact the wall of the housing, which is cool and heat conductive, any molten metal penetrating between the outer surface 40 and the adjacent wall of the housing is likely to freeze and thus remain in place. Therefore, such additional sealing is not especially required. The inner wall of the housing may be provided with pairs of short upstanding locating strips 42 (FIG. 2), at least along the bottom wall, to facilitate installation and proper location of the confinement elements and to prevent their movement during use.

To form the confinement region 38, the confinement elements 35 and 36 are spaced apart from each other and from the joint 25, although the spacing may be virtually zero provided there is enough space to accommodate even a small amount of the molten metal and to allow it to escape. As the spacing increases, the capacity of the confinement region for holding molten metal desirably increases, but the size of other regions of the gap within the housing, i.e. regions that may be needed for other purposes, undesirably decreases. In practice the spacing between these elements may range from 0 to 150 mm, preferably 0 to 100 mm, and more preferably from 10 to 50 mm. If the confinement region 38 is enclosed on all sides, it could conceivably fill up with molten metal if the amount of leakage is sufficiently great, but this would not matter, provided the desired effect of preventing leakage into other regions of the housing were prevented.

In the drawings, the confinement elements 35 and 36 extend up to the top of the refractory liner units on each side of the channel 11. In practice, however, there is no need to extend these elements higher than a horizontal level corresponding to a predetermined maximum working height of molten metal conveyed through the trough section in use, as there will be no molten metal leakage above this level. This level is indicated by dashed line 43 in FIG. 2 as an example. Clearly, molten metal leaking from the channel 11 into the interior of the housing 20, i.e. into the confinement region 38, would never rise above this level and would therefore not flow over the top of confinement elements if extended upwardly to at least this level.

As noted, the confinement elements 35 and 36 prevent any molten metal leaking from joint 25 from moving to other regions of the interior of the housing 20. This is particularly desirable when these other regions contain devices that may be harmed by contact with molten metal, e.g. electrical heating elements 45 used to keep the molten metal in channel 11 at a desired elevated temperature. Such elements may be of the kind disclosed in U.S. Pat. No. 6,973,955 to Tingey et al. (the disclosure of which is specifically incorporated herein by this reference). Although the exemplary embodiment is designed to keep molten metal out of the regions containing such devices, it may also be prudent to provide one or more drain holes in these other regions at a level below the lowermost point of the devices. Hence any molten metal reaching these regions (e.g. from a crack in the refractory liner remote from joint 25) will leak out without causing harm to the devices.

While the exemplary embodiment of FIGS. 1 to 3 shows a trough section 10 having two intermediate refractory liner units 14 and 15, there may be more than two of such units in order to allow the trough section to be lengthened, if desired. In such cases, pairs of confinement elements are preferably provided adjacent each butt joint between the intermediate units. In practice, however, it is found that trough sections having just two of such intermediate units is normal because trough sections longer than about 2 m are quite cumbersome and heavy to manipulate, and it is possible to construct trough sections of lengths up to 2 m with just two intermediate liner units 14 and 15 as shown.

FIGS. 5 to 8 of the drawings show an alternative embodiment of a trough section 10. This alternative embodiment is similar to that of FIGS. 1 to 4, but the confinement elements 35, 36 have been omitted and have been replaced by narrow piers 46 of refractory material (e.g. wollastonite) locating and supporting the refractory liner units at each side of the channel at the joint 25. In this embodiment, there is no provision for confinement of molten metal leaking from joint 25, but such confinement could be provided in the manner of FIGS. 1 to 4, if desired. Instead, this alternative embodiment is primarily intended to ensure that heat gain from heating elements 45 by the molten metal within the channel 11 is maximized by making intermediate refractory liner units 14 and 15 from a refractory material that is of high heat conductivity, while also ensuring that heat loss by the molten metal passing over the ends of the refractory liner 12 (end liner units 16 and 17) is minimized. At the end refractory liner units 16 and 17 there is contact between the units and the metal end walls 23 of the housing 20 and heat may be lost through these units to the housing. This heat loss is minimized by making the end units 16 and 17 from a refractory material that is poorly heat conductive. Any difference of heat conductivity between the end liner units 16 and 17 and the intermediate liner units 14 and 15 (with the intermediate units being more heat conductive than the end units) would help to improve heat gain in the center of the channel while reducing heat loss at one or both ends, but it is preferably to make the difference of the heat conductivities relatively large. Ideally, the heat conductivity of the material used for the intermediate liner units is preferably at least 3.5 W/m−° K (watts per meter of thickness per degree Kelvin). As the conductivity of the material used for the intermediate units decreases, the temperature of the elements 45 must be raised to compensate, which is undesirable. On the other hand, as the conductivity of the material increases, the cost of the material undesirably tends to increase, especially if very high conductivity and exotic refractory materials are employed. A preferred range for the conductivity of the materials chosen for the intermediate units is 3.5-20 W/m−° K, and even more preferably 5-10 W/m−° K, in order to provide a compromise between good conductivity and reasonable cost. A particularly preferred conductivity has been found to be about 8 W/m−° K. In contrast, in the case of the end refractory liner units 16 and 17, the conductivity of the refractory material is preferably below about 1.4 W/m−° K, e.g. in a range of about 0.2-1.1 W/m−° K.

Materials of high heat conductivity suitable for the intermediate refractory liner units 14, 15 include silicon carbide, alumina, cast iron, graphite, etc. The intermediate refractory liner units may if desired be coated, at least on their external surfaces, with a conductive, highly heat absorptive coating to maximize radiant heat transfer from heating elements 45.

Materials suitable for the refractory liner end units 16, 17 include fused silica, alumina, alumina-silica blends, calcium silicate, etc.

The end units 16 and 17 are preferably be made as short as possible in the longitudinal direction of the channel 11 while still providing adequate structural integrity and good insulation against heat loss to the end wall 23 of the housing. In practice, suitable lengths depend on the material from which the end units are made, but are generally in a range from 25 to 200 mm, and preferably from 75 to 150 mm. It is also desirable to provide an end unit of relatively low heat conductivity at both ends of the trough section, although an end unit of this kind may be provided at just one end of the trough section when circumstances make it appropriate, e.g. if one end of the trough section connects directly to a metal melting furnace so that the end wall 23 is at such a high temperature from proximity to the furnace that heat loss through the end wall is negligible or even heat gain is conceivable. The end unit may then be made of a material of higher heat conductivity (similar to the intermediate units) to ensure thermal transfer to the molten metal in the channel even at this end of the trough section.

Figure 5:
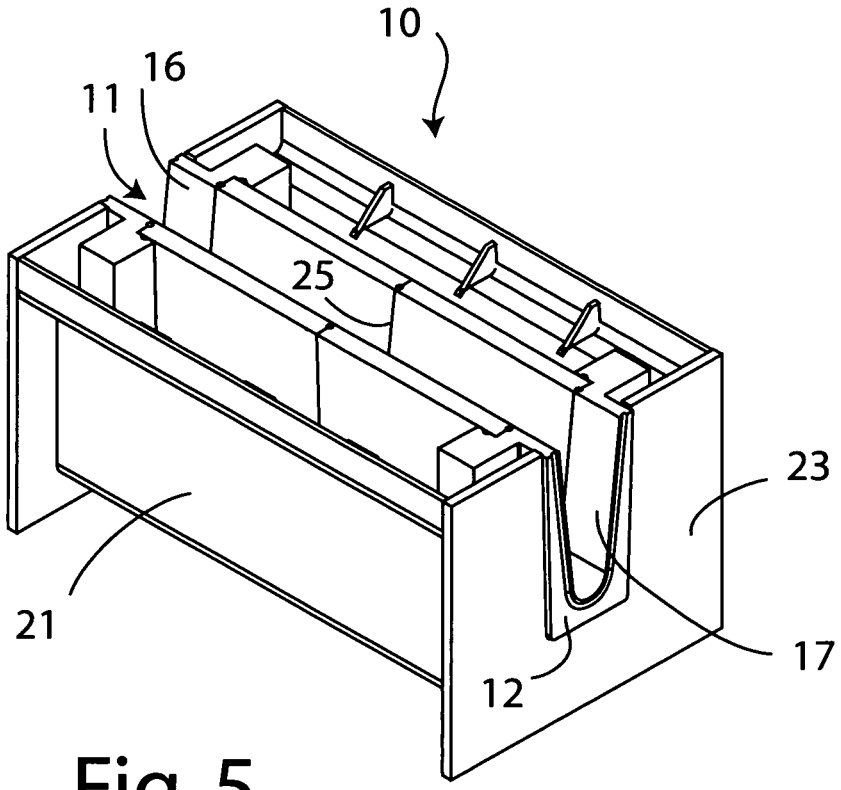
FIG. 5 is a perspective view similar to FIG. 1, but showing an alternative exemplary embodiment.
Figure 6:
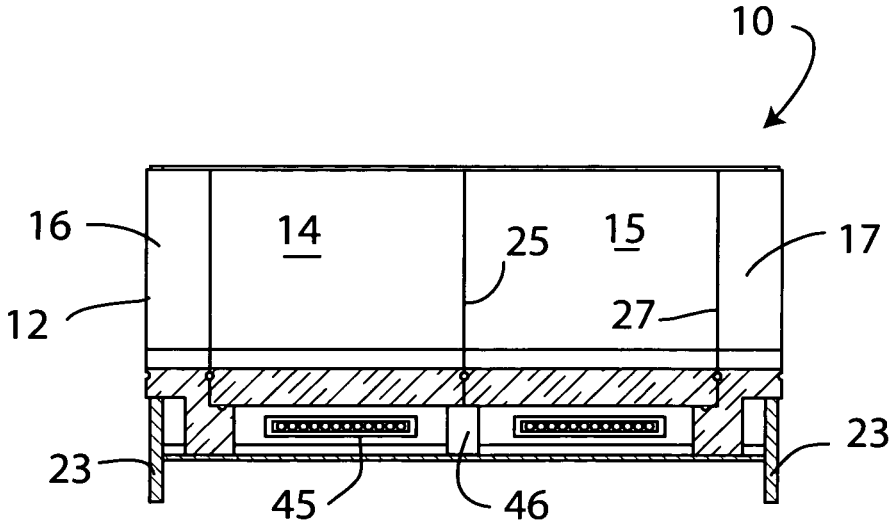
FIG. 6 is a vertical longitudinal cross-section of the trough section of FIG. 5.
Figure 7:
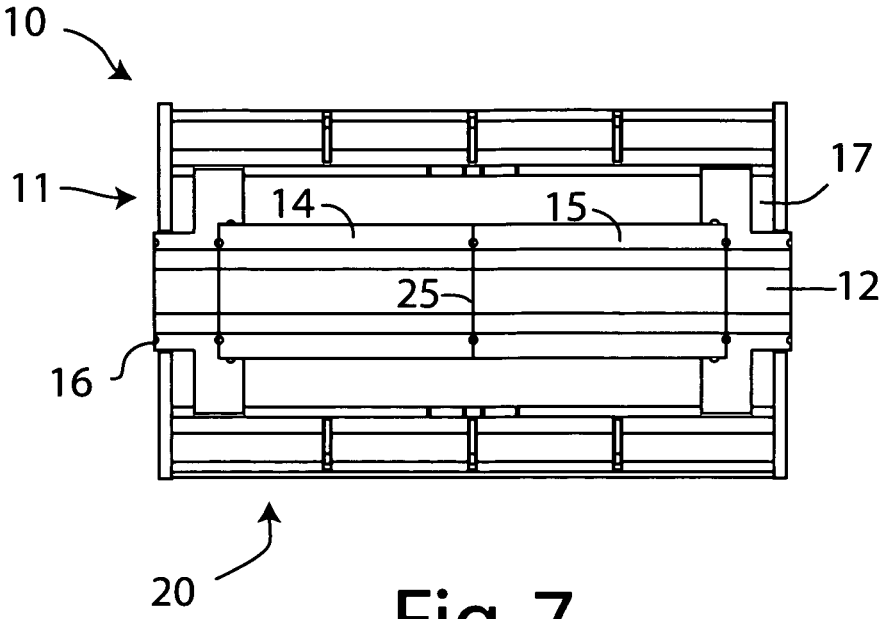
FIG. 7 is a top plan view of the trough section of FIGS. 5 and 6.
Figure 9:
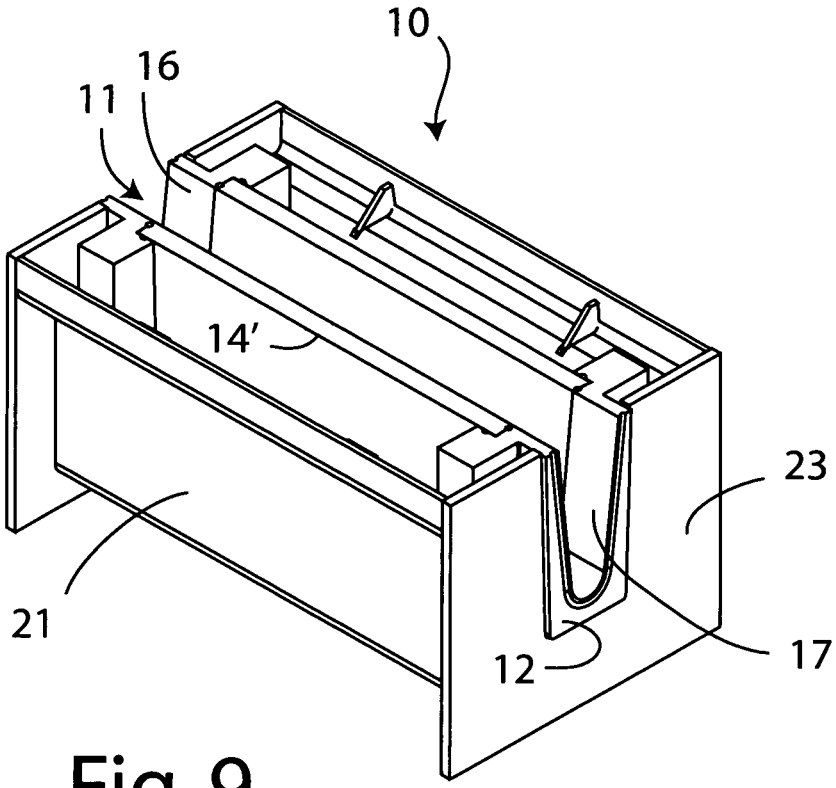
FIG. 9 is a perspective view of a further alternative exemplary embodiment of a trough section.

While FIGS. 5 to 7 illustrate an embodiment having two intermediate liner units 14, 15, a still further alternative exemplary embodiment may have just one intermediate liner unit. Such an embodiment is shown in FIG. 9 where there is just one intermediate liner unit 14'. The use of just one intermediate liner unit avoids the formation of an intermediate joint (joint 25 of FIGS. 5 to 7) with its potential for molten metal leakage. However, as explained earlier, it has been found that there is a practical maximum length for the intermediate liner units beyond which structural weaknesses may increase, so the length of the trough section 10 of FIG. 9 may be more limited than that of the earlier embodiments. In this exemplary embodiment, there may also be just one intermediate unit rather than two or more. The single intermediate liner unit 14' is made of a material of high heat conductivity and at least one (and preferably both) of the end liner units 16, 17 are made of a material of low conductivity, as before.

As mentioned earlier, all of the trough sections of the exemplary embodiments may be provided with one or more layers of heat insulating material in available space within the gap between the refractory liner 12 and the inner surface of the housing 20, particularly adjacent to the sidewalls. The insulation may be, for example, an alumino-silicate refractory fibrous board, microporous insulation (e.g. silica fume, titanium dioxide, silicon carbide blend), wollastonite, mineral wool, etc. The insulation keeps the outer surfaces of the housing at reasonably low temperatures so that operators are not exposed to undue risk of sustaining burns, and helps to maintain the desired elevated temperature of the molten metal within the metal channel. Clearly, such insulation is not positioned between heating elements and the refractory liner units in those embodiments that employ such heating elements, and optionally the confinement regions 38 are kept free of insulation to force the freeze plane of escaping molten metal to be at the inside surface of the housing 20.

While the above embodiments show trough sections as examples of molten metal containing vessels, other vessels having refractory liners of this kind may be employed, e.g. containers for molten metal filters, containers for molten metal degassers, crucibles, or the like. When the vessel is a trough or trough section, the trough or trough section may have an open metal-conveying channel that extends into the trough or trough section from an upper surface, e.g. as shown in the exemplified embodiments. Alternatively, the channel may be entirely enclosed, e.g. in the form of a tubular hole passing through the trough or trough section from one end to the other, in which case the refractory liner resembles a tube or pipe. In another exemplary embodiment, the vessel acts as a container in which molten metal is degassed, e.g. as in a so-called "Alcan compact metal degasser" as disclosed in PCT patent publication WO 95/21273 published on Aug. 10, 1995 (the disclosure of which is incorporated herein by reference). The degassing operation removes hydrogen and other impurities from a molten metal stream as it travels from a furnace to a casting table. Such a vessel includes an internal volume for molten metal containment into which rotatable degasser impellers project from above. The vessel may be used for batch processing, or it may be part of a metal distribution system attached to metal conveying vessels. In general, the vessel may be any refractory metal containment vessel having several abutting refractory liner units positioned within a housing.

The vessels to which the invention relates are normally intended for containing molten aluminum and aluminum alloys, but could be used for containing other molten metals, particularly those having similar melting points to aluminum, e.g. magnesium, lead, tin and zinc (which have lower melting points than aluminum) and copper and gold (that have higher melting points than aluminum).

What is claimed is:

1. A vessel used for containing molten metal, said vessel comprising:

a refractory liner having at least two refractory liner units positioned end to end, with a joint between said units, the units each having an exterior surface and a metal-contacting interior surface, a housing at least partially surrounding the exterior surfaces of the refractory liner units with a gap present between the exterior surfaces and the housing; and a pair of molten metal confinement elements, impenetrable by molten metal, spaced apart from each other and positioned within the gap on each opposite side of the joint, at least below a horizontal level corresponding to a predetermined maximum working height of molten metal held within said vessel in use, to partition the gap into a molten metal confinement region between said elements and other region(s) of the gap.

2. The vessel of claim 1, in the form of a trough section for conveying molten metal, said refractory liner being elongated and having an inlet for molten metal inflow at one end and an outlet for molten metal outflow at an opposite end.

3. The vessel of claim 2, wherein the metal contacting interior surfaces of the liner units form an open-topped molten metal conveying channel.

4. The vessel of claim 1, wherein said other region(s) of the gap contain(s) a heating device for said refractory liner.

5. The vessel of claim 1, wherein said housing contains at least one opening within said metal confinement region of a size to allow molten metal to flow therethrough.

6. The vessel of claim 1, wherein said housing contains at least one opening within said other region(s) of the gap sized to allow molten metal to flow therethrough.

7. The vessel of claim 1, wherein the confinement elements are made of a refractory material that is resistant to attack by molten metal.

8. The vessel of claim 1, wherein the confinement elements are sealed against said exterior surfaces by means of a refractory sealant element.

9. The vessel of claim 8, wherein the confinement elements have longitudinal grooves for receiving said sealant element.

10. The vessel of claim 1, wherein the pair of confinement elements are separated from each other by a distance of 0 to 150 mm.

11. The vessel of claim 1, wherein the pair of confinement elements are separated from each other by a distance of 10 to 50 mm.

* * * * *

UNITED STATES PATENT AND TRADEMARK OFFICE

CERTIFICATE OF CORRECTION

PATENT NO. : 8,657,164 B2
APPLICATION NO. : 13/066474
DATED : February 25, 2014
INVENTOR(S) : Eric W. Reeves et al.

It is certified that error appears in the above-identified patent and that said Letters Patent is hereby corrected as shown below:

On the Title page, item (54) and in the Specification, column 1, lines 3-4 after "FOR CONTAINING MOLTEN METAL", please replace "METAL" with --METALS--.

In the Claims:

In Column 10, Claim 1, line 44, please add the following:

after "gap" insert --, wherein the molten metal confinement elements are configured to prevent lateral movement of molten metal beyond the molten metal confinement region-- before ".".

Signed and Sealed this
Thirteenth Day of May, 2014

Michelle K. Lee

Michelle K. Lee
*Deputy Director of the United States Patent and Trademark Office*